US011472215B2

(12) United States Patent
Rosebrough et al.

(10) Patent No.: US 11,472,215 B2
(45) Date of Patent: Oct. 18, 2022

(54) BOOK AND TOY COMBINATION

(71) Applicant: Wonderbox Workshop Limited, London (GB)

(72) Inventors: Stephen Rosebrough, Erie, CO (US); Jeremy Boreham, Bath (GB)

(73) Assignee: Wonderbox Workshop Limited, London (GB)

( * ) Notice: Subject to any disclaimer, the term of this patent is extended or adjusted under 35 U.S.C. 154(b) by 0 days.

(21) Appl. No.: 16/857,892

(22) Filed: Apr. 24, 2020

(65) Prior Publication Data

US 2021/0291575 A1 Sep. 23, 2021

(30) Foreign Application Priority Data

Mar. 20, 2020 (GB) ..... 2004104
Mar. 30, 2020 (GB) ..... 2004648

(51) Int. Cl.
*B42D 3/12* (2006.01)
*B42D 3/08* (2006.01)
*A63H 33/38* (2006.01)

(52) U.S. Cl.
CPC ..... *B42D 3/12* (2013.01); *A63H 33/38* (2013.01); *B42D 3/08* (2013.01)

(58) Field of Classification Search
CPC ..... B42D 3/08; B42D 3/12; A63H 33/38
USPC ..... D19/26–32
See application file for complete search history.

(56) References Cited

U.S. PATENT DOCUMENTS 3,918,180 A * 11/1975 Chamberlin ..... B42D 1/004 434/178
4,200,945 A * 5/1980 Ellis ..... B42D 3/00 281/43
4,487,590 A 12/1984 Becker et al.
4,616,851 A * 10/1986 Mann ..... B42D 3/00 281/15.1
D384,100 S * 9/1997 Derraugh ..... D19/26
D426,055 S * 6/2000 Evans ..... D19/32
6,234,534 B1 * 5/2001 Warren ..... A63H 33/38 116/239
6,419,493 B1 * 7/2002 Cole ..... G09B 19/10 281/15.1
7,258,367 B2 * 8/2007 Legrand ..... A63H 33/38 281/15.1
2005/0227208 A1 * 10/2005 Beascoa ..... G09B 27/08 434/131

(Continued)

FOREIGN PATENT DOCUMENTS

CN 201922674 U 8/2011
EP 0832673 A2 * 4/1998 ..... A63H 3/003
KR 10-2016-0001469 A 1/2016

*Primary Examiner* — Kyle R Grabowski
(74) *Attorney, Agent, or Firm* — Winstead PC

(57) ABSTRACT

The present invention relates to a book comprising a first outer cover having a substantially planar body defining a first aperture extending therethrough; a second outer cover having a substantially planar body defining a second aperture extending therethrough; and at least one inner element located between the first and second outer covers, the or each inner element having a substantially planar body defining an inner element aperture extending therethrough; wherein at least a portion of the first and second apertures and the or each inner element aperture are aligned with one another to define a receiving aperture extending through the book.

10 Claims, 6 Drawing Sheets

(56) References Cited

U.S. PATENT DOCUMENTS

| | | | | |
|---|---|---|---|---|
| 2013/0049346 | A1* | 2/2013 | Derraugh | B42B 5/04 281/43 |
| 2013/0257031 | A1* | 10/2013 | Lai | B42F 3/003 281/15.1 |
| 2016/0166943 | A1 | 6/2016 | Roemen et al. | |

* cited by examiner

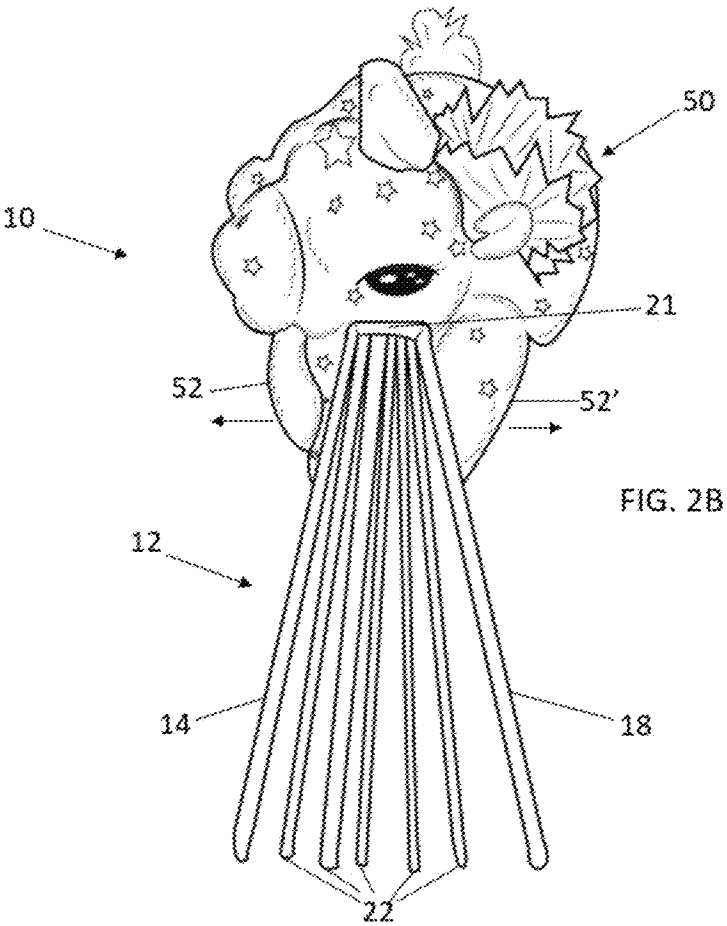
FIG. 2B
FIG. 2B
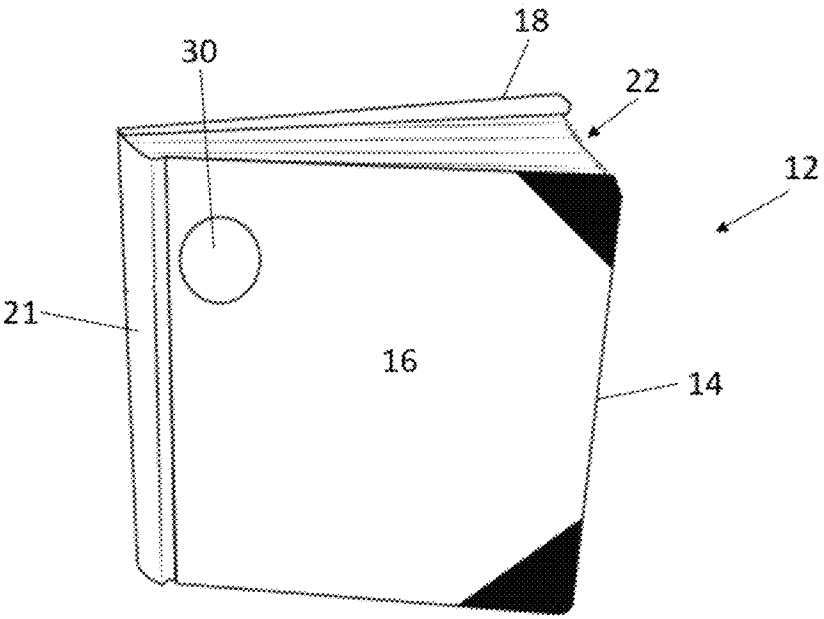
FIG. 2A

BOOK AND TOY COMBINATION

The present invention relates to a book with a receiving aperture extending therethrough. The present invention further relates to such a book with an item such as a soft toy reversibly engaged with the receiving aperture.

BACKGROUND OF THE INVENTION

It is well known and accepted that a young child's attention and engagement when being read a book can be significantly increased if there is some physical way in which the child can interact with the book. For example, there are children's books that include an integral puppet which is operated by the reader as they progress through the story, thereby engaging the attention of the child. Other techniques are to include surfaces on the pages with different tactile qualities which relate to the story being told that the child can touch and interact with during the activity.

However, once the story has been read and the book closed, these interactive devices cease to engage with, and stimulate, the child.

One solution to this is to recreate the characters in the books as toys which the child can play with and the stories as cartoons which can be watched on television. Although this serves to engage the child more fully in the characters and stories, it tends to increase the desire of the child to engage with the television rather than increase their desire to engage with books at an early age. Further, the physical interaction of the child with the associated toy is limited. Also, toys and books become physically separated/lost and therefore no longer server the combined function that was originally intended There is therefore a need for a means of increasing the child's engagement with books and their associated characters and which maintains the physical interaction of the child with both.

The present invention seeks to address the problems of the prior art.

SUMMARY OF THE INVENTION

Aspects of the present invention are set out in the attached claims.

According to an aspect of the present invention, there is provided a book comprising: a first outer cover having a substantially planar body defining a first aperture extending therethrough; a second outer cover having a substantially planar body defining a second aperture extending therethrough; and at least one inner element located between the first and second outer covers, the or each inner element having a substantially planar body defining an inner element aperture extending therethrough; wherein at least a portion of the first and second apertures and the or each inner element aperture are aligned with one another to define a receiving aperture extending through the book.

In one embodiment, the dimensions of the first and second apertures and the or each inner element aperture are the same as one another.

In a further embodiment, the first and second apertures and the or each inner element aperture are aligned with one another to define a receiving aperture with the same dimensions as the first and second apertures and the or each inner element aperture. This results in a receiving aperture extending through the book that is made up of aligned and equally dimensioned first, second and inner element apertures. However, it is to be appreciated that the first and second and the or each inner element apertures need not be of the same dimension or exactly aligned with one another provided that a portion of each of the aforementioned apertures are aligned so as to provide a receiving aperture extending through the book.

Further, the receiving aperture may be of any suitable shape and dimensions to allow an item to be received therethrough. For example, the receiving aperture may be square, rectangular, circular or any other regular or irregular shape suitable for purpose.

In one embodiment, the planar body of the first outer cover defines a first edge portion, the planar body of the second outer cover defines a second edge portion and the planar body of the or each inner element defines a third edge portion, wherein the first, second and third edge portions are aligned and engaged with one another to form a spine.

Preferably, the receiving aperture is located adjacent the spine. This allows the pages of the book to be turned whilst an item is received through the receiving aperture. However, it is to be appreciated that the receiving aperture may be located at any suitable position through the book. For example, the receiving aperture may be located distal to the spine, at a corner of the book or any other suitable position. It is also to be appreciated that the position of the receiving aperture may be determined by an illustration or similar provided on the first outer cover of the book and thus the receiving aperture may not always be located adjacent the spine.

It is also to be appreciated that multiple receiving apertures may be provided, thereby providing multiple options to a user to locate an item through the book. For example, multiple receiving apertures may be provided to provide choice of where to locate a single aperture. Alternatively, multiple apertures may allow a plurality of items to be received through the book.

In one embodiment, the book comprises a plurality of inner elements.

In a further embodiment, each of the plurality of inner elements have the same dimensions as one another.

In one embodiment, the first and second outer covers have the same dimensions as one another.

One or both of the first and second apertures may be reinforced.

A second aspect of the present invention provides a book system comprising: a book according to a first aspect of the present invention; and an item reversibly engaged with the receiving aperture.

In one embodiment, the item comprises a toy.

Preferably, the toy comprises a protruding element that is extendable through the receiving aperture.

In one embodiment, the protruding element is resiliently pliable.

In a further embodiment, the toy comprises a soft toy and the protruding element comprises one or more limbs.

In one embodiment, the first and second outer covers are moveable relative to one another when the item is engaged with the receiving aperture. This allows the book to be manipulated, looked at, read or otherwise interacted with, without first requiring disengagement of the item from the book.

In a further embodiment, the item extends around the book and through the receiving aperture to form a closed loop around a portion of the book. This serves to further secure the item to the book.

BRIEF DESCRIPTION OF THE DRAWINGS

FIG. 2A is a perspective view of the book of the book system of FIG. 1;

FIG. 2B is a view from above of the book system of FIG. 1;

DETAILED DESCRIPTION

Figure 1A:
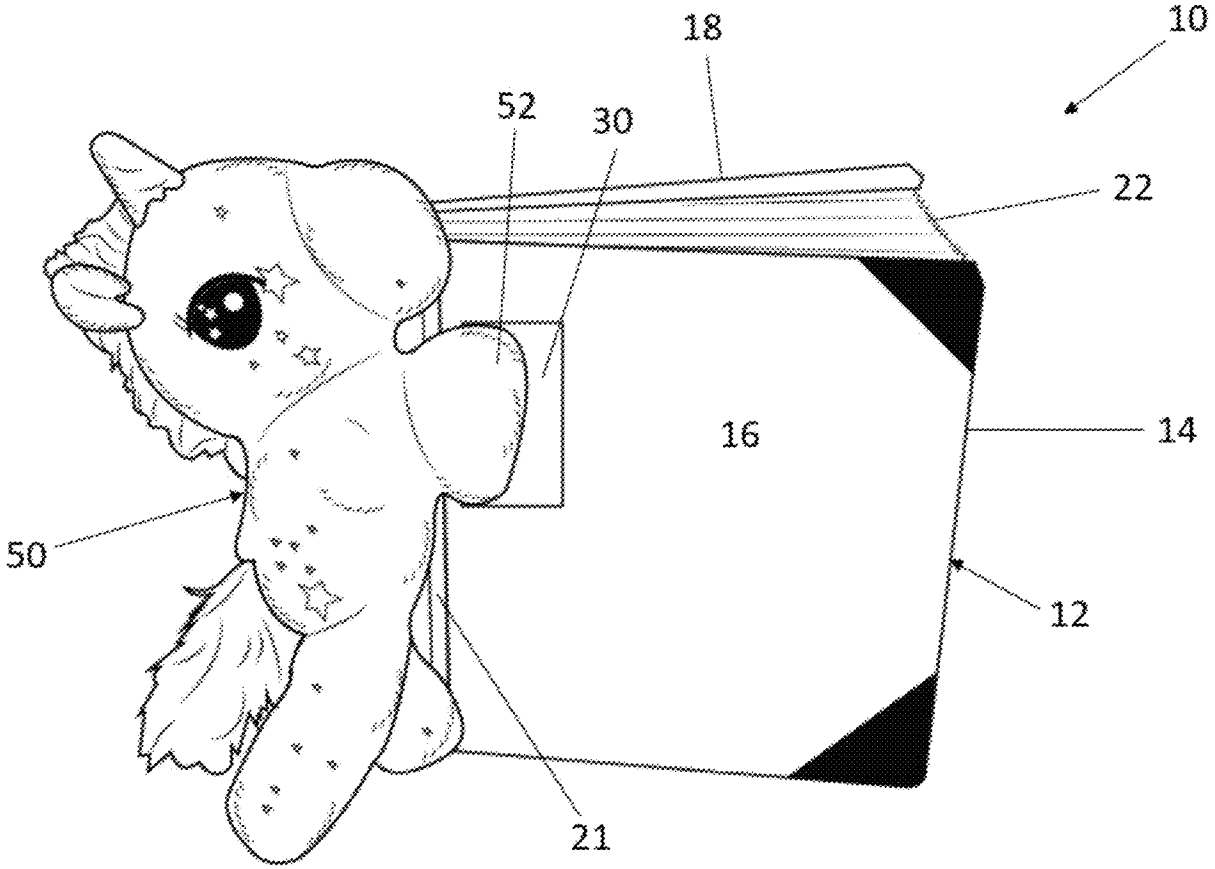
FIGS. 1A and 1B are illustrations of a first embodiment of a book system in accordance with a second aspect of the invention.
Figure 1B:
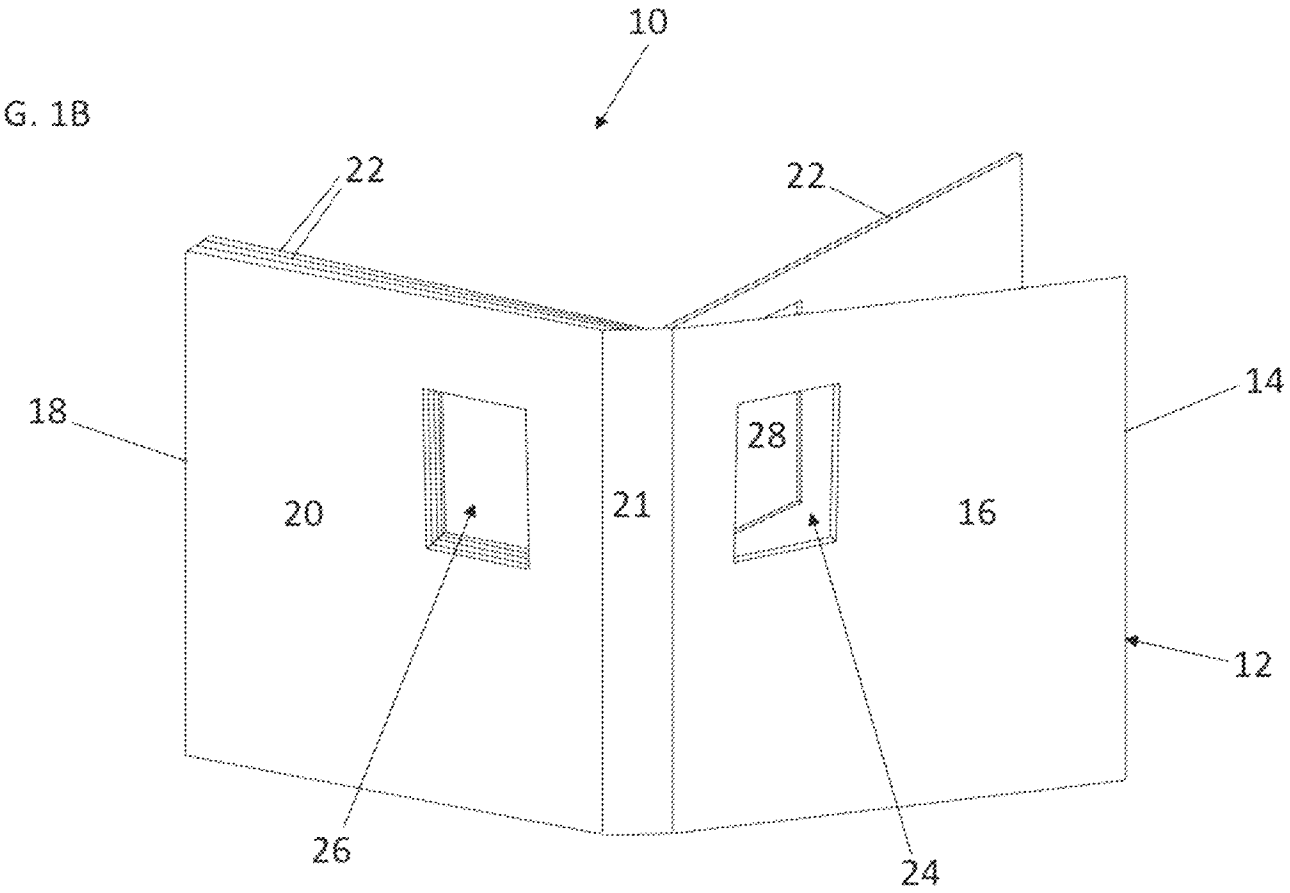

FIG. 1 shows a book system 10 comprising a book 12 and an engaged toy 50.

Book 12 comprises a front cover 14 having a substantially planar outer surface 16. Book 12 further comprises a rear cover 18 having a substantially planar outer surface 20. Each of the front and rear covers 14, 18 are connected along one edge to spine 21 and are pivotable about spine 21. A plurality of pages 22 are located between front and rear covers 14, 18, each of pages 22 being connected along one edge to spine 20.

Front cover 14 defines an aperture 24 therethrough. Rear cover 18 also defines an aperture 26 therethrough and each of pages 22 define an aperture 28 therethrough. Front cover 14, pages 22 and rear cover 18 are aligned such that a portion of each of apertures 24, 26, 28 are aligned so as to define a single aperture 30 extending all the way through book 12.

In the embodiment of FIGS. 1 and 2, each of apertures 24, 26, 28 have the same shape and size as one another, and each of apertures 24, 26, 28 aligned with one another such that single aperture 30 has the same shape and size as apertures 24, 26, 28. However, it is to be appreciated that apertures 24, 26, 28 may have any suitable size and shape, the same as or different to the other apertures provided that at least a portion of each of apertures 24, 26, 28 are aligned so as to form a single aperture 30 extending through front cover 14, rear cover 18 and each of pages 22, provided single aperture 30 is of sufficient size and suitable shape to accommodate a portion of toy 50 therethrough.

Figure 3B:
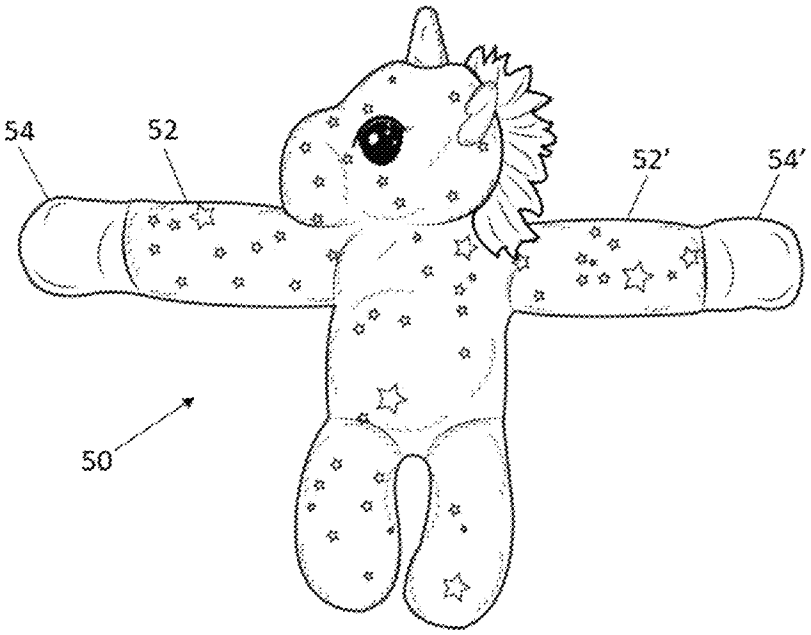
FIG. 3B is a perspective front view of the toy of FIG. 3A.

In FIG. 1, toy 50 comprises a plush or soft toy comprising resilient arms 52, 52' that are moveable between an open configuration in which arms 52, 52' are apart from one another (see FIG. 3A) and a closed configuration in which arms 52, 52' are adjacent one another (see FIG. 3B). For example, the plush toy may be provided with snap-band type arms that are moveable between a straightened configuration and a curved configuration. Such toys can be worn on the arm of a child when disengaged with the book 12.

In the embodiment of FIGS. 1 to 3B, the arms 52, 52' are moveable relative to one another between the closed and open configurations on application of force to the arms 52, 52' in the directions shown by the arrows in FIG. 2B. On release of the applied force on arms 52, 52', the arms will return to their original position in the closed configuration.

Figure 3A:
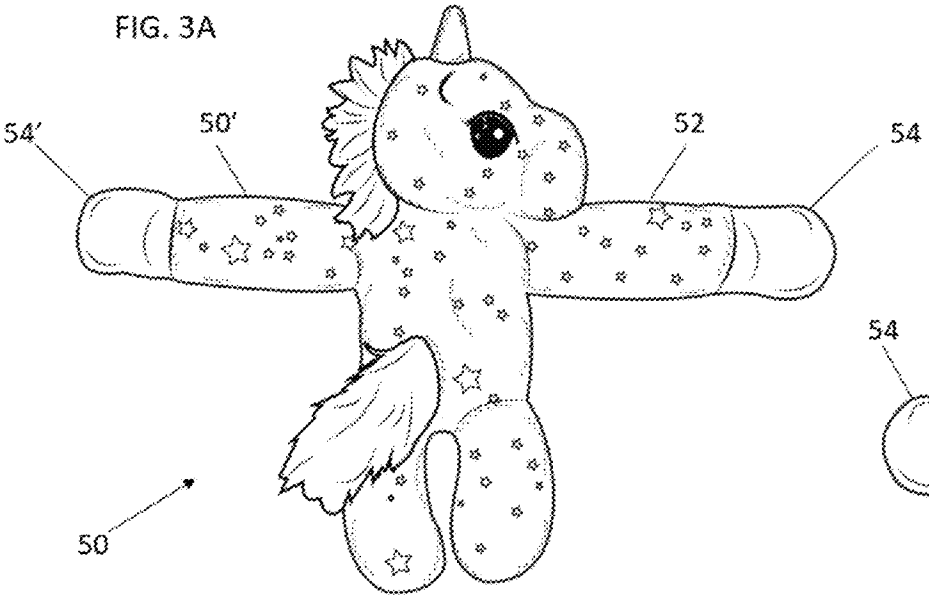
FIG. 3A is a perspective rear view of the toy of the embodiment of FIG. 1 showing the arms in the open configuration.

Alternatively, the arms 52, 52' may assume a straightened configuration (as shown in FIGS. 3A and 3B) on application of sufficient pressure to the arms in the directions shown by the arrows in FIG. 2B and require force to be applied to the arms in the opposing direction to un-straighten the arms, such that they then return naturally to the closed configuration of FIGS. 1 and 2B.

Thus, on application of pressure to separate arms 52, 52' from one another, toy 50 may be located adjacent spine 20 of book 12 such that on controlled release of applied pressure, as arms 52, 52' are returned towards the closed position, the distal portion 54 of arm 52 may be passed through single aperture 30 from one side of book 12 and the distal portion 54' of arm 52' may be passed through single aperture 30 from the opposite side of book 12, such that on full return of arms 52, 52' to the closed configuration, toy 50 will be wrapped around spine 21 and engaged with book 12.

Toy 50 can be disengaged from book 12 by applying pressure to arms 52, 52' to move arms 52, 52' apart into the open configuration and remove the distal portions 54, 54' of respective arms 52, 52' out through single aperture 30.

When the book 12 relates to a child's toy, the item releasably secured to book 12 may be disengaged from the book 12 for the child to cuddle while having the book 12 read to them. However, it is to be appreciated that the location of the single aperture 30 i.e. spaced apart from the spine 21, allows the front and rear covers 14, 18 to be pivoted apart from one another to allow access to the pages 22 whilst the arms 52, 52' of toy 50 remains engaged with the book 12. This allows the book to be played with by a child without having to disengage the toy 50 from the book 12, if desired.

Although the embodiment described shows a toy 52, it is to be appreciated that the item engaged with single aperture 30 of book 12 may be any object which can assume a closed configuration around spine 21. For example, a slap-band wristwatch may be engaged around spine 21, the distal ends of the slap-band passing through single aperture 30 in the same way as distal portions 54, 54' of respective arms 52, 52'. For example, where the book relates to teaching a child to tell the time, such a watch-book combination will prove a useful teaching aid for the child to learn from.

Alternatively, rather than having resilient arms, toy 50 may be provided with soft arms 52, 52' having distal portions 54, 54' provided with complementary inter-engaging means such as, but not limited to, hook and loop fastening or snap fit poppers or button and button hole engagement means.

Figure 4:
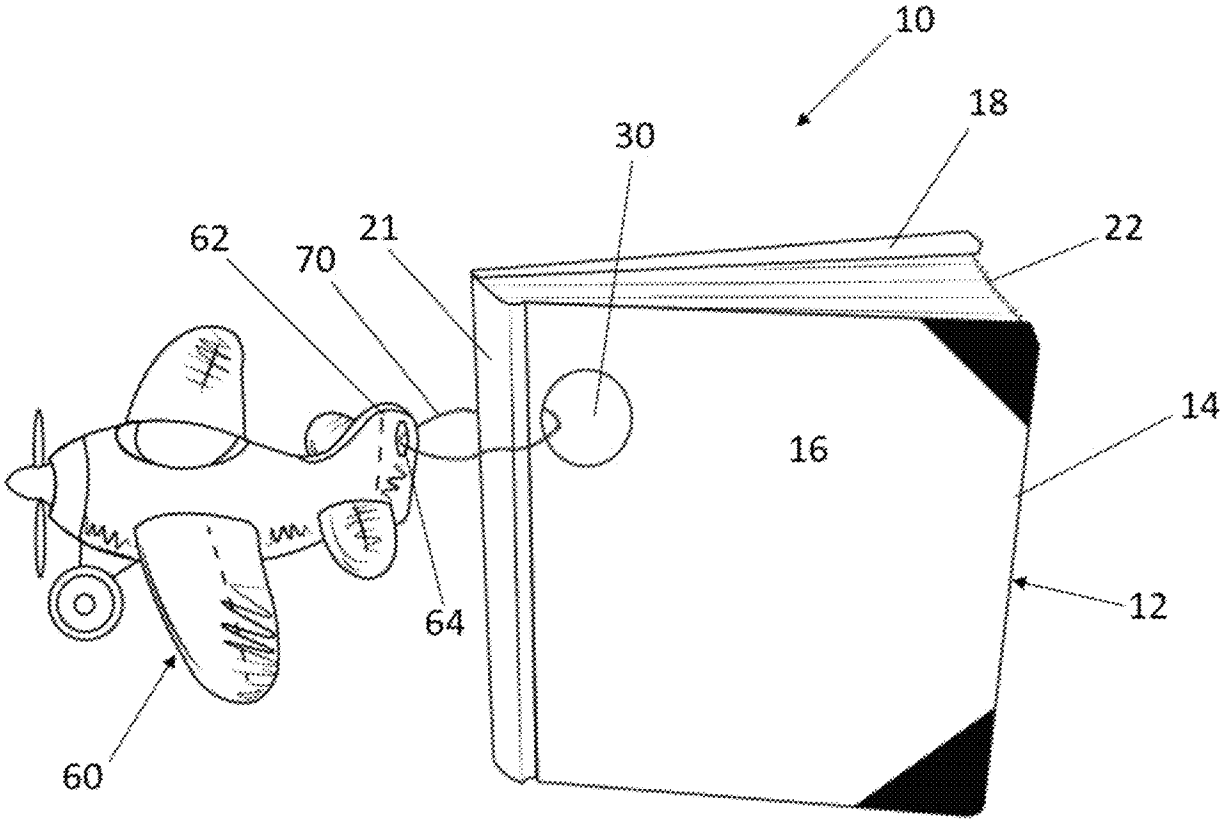
FIG. 4 is an illustration of a second embodiment of a book system in accordance with a second aspect of the invention.

It is also possible to attach a toy 50 without snap band arms to book 12 by providing a releasable strap 70 that engages with the item e.g. toy and passes through single aperture 30 to hold the item in engagement with book 12. FIG. 4 shows a toy plane 60 with a tail 62 defining an aperture 64. A strap 70 having a releasable closer is provided such that the strap can be moved between and open configuration in which the ends 68, 68' are separated from one another and a closed configuration in which the ends 68, 68' are releasably engaged with one another.

When in the open configuration, strap 70 is extended through the aperture 64 in tail 62 and through single aperture 30 in book 12 before the ends 68, 68' of step 66 are re-engaged with one another, thereby securing toy plane 60 to book 12.

Figure 5:
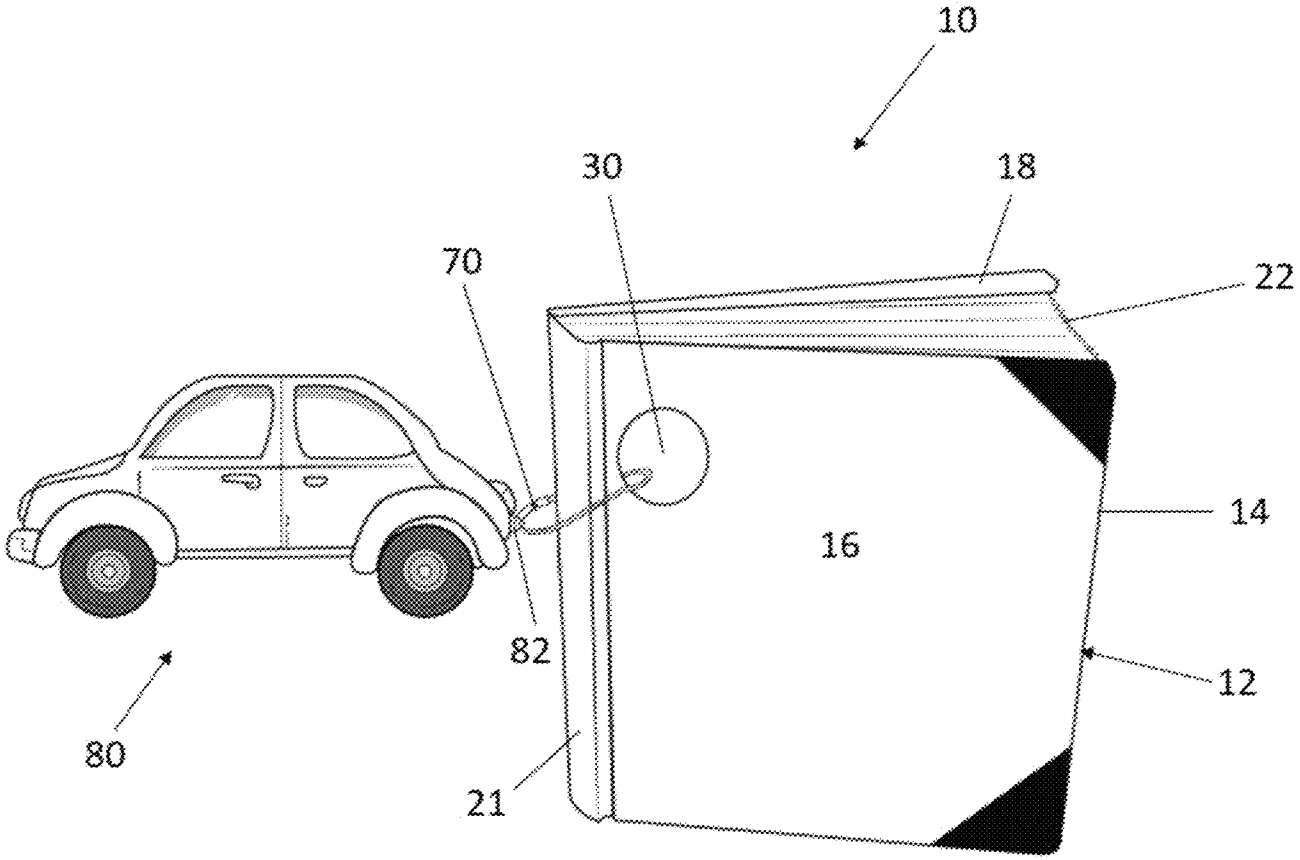
FIG. 5 is an illustration of a third embodiment of a book system in accordance with a second aspect of the present invention.

FIG. 5 shows a toy car 80 provided with a fixing point aperture 82 through which a strap 70 can extend and operate to releasably attach a car to book 12 in the same manner as discussed above with respect to FIG. 4.

The use of such a strap 70 or similar type of elongate engagement member allows the attachment of one or more items to book 12. For example, one or more items such as, but not limited to, toys, spectacles, torches and the like may be releasably secured to book 12.

What is claimed is:

1. A book system comprising:

a. a first outer cover having a substantially planar body defining a first aperture extending therethrough;

a second outer cover having a substantially planar body defining a second aperture extending therethrough; and at least one inner element located between the first and second outer covers, the or each inner element having a substantially planar body defining an inner element aperture extending therethrough;

wherein at least a portion of the first and second apertures and the or each inner element aperture are aligned with one another to define a receiving aperture extending through the book;

wherein the planar body of the first outer cover defines a first edge portion, the planar body of the second outer cover defines a second edge portion, and the planar body of the or each inner element defines a third edge portion, wherein the first, second and third edge portions are aligned and engaged with one another to form a spine; and b. a toy that is reversibly engaged with the receiving aperture, wherein the toy comprises arms that occupy substantially all of the receiving aperture and extend through the receiving aperture to form a closed loop around a portion of the spine to attach the toy to the spine of the book system, and wherein said closed loop can be reversibly opened to release the toy from the book system.

2. A book system according to claim 1, wherein the dimensions of the first and second apertures and the or each inner element aperture are the same as one another.

3. A book system according to claim 2, wherein the first and second apertures and the or each inner element aperture are aligned with one another to define a receiving aperture with the same dimensions as the first and second apertures and the or each inner element aperture.

4. A book system according to claim 3, wherein the receiving aperture is located adjacent the spine.

5. A book system according to claim 1, wherein the book comprises a plurality of inner elements.

6. A book system according to claim 5, wherein each of the plurality of inner elements have the same dimensions as one another.

7. A book system according to claim 1, wherein the first and second outer covers have the same dimensions as one another.

8. A book system according to claim 1, wherein one or both of the first and second apertures are reinforced.

9. A book system according to claim 1, wherein the toy comprises a soft toy and the snap-band type arms comprise one or more limbs.

10. A book system according to claim 1, wherein the first and second outer covers are moveable relative to one another when the toy is engaged with the receiving aperture.

* * * * *